US006255573B1

(12) United States Patent
Izen et al.

(10) Patent No.: US 6,255,573 B1
(45) Date of Patent: Jul. 3, 2001

(54) TENSION MEMBER FOR PERCUSSION INSTRUMENT

(75) Inventors: Mark Izen, Chestnut Hill, MA (US); Terry Kwok, Kowloon (HK)

(73) Assignee: First Act, Inc., Needham, MA (US)

( * ) Notice: Subject to any disclaimer, the term of this patent is extended or adjusted under 35 U.S.C. 154(b) by 0 days.

(21) Appl. No.: 09/461,622

(22) Filed: Dec. 15, 1999

Related U.S. Application Data

(63) Continuation-in-part of application No. 09/218,798, filed on Dec. 21, 1998.

(51) Int. Cl.[7] ..... G10D 13/12
(52) U.S. Cl. ..... 84/411 R; 84/411 A; 84/413
(58) Field of Search ..... 84/411 R, 411 A, 84/413, 418

(56) References Cited

U.S. PATENT DOCUMENTS

| | | | | |
|---|---|---|---|---|
| 4,475,434 | | 10/1984 | Willis | 84/411 R |
| 4,549,462 | | 10/1985 | Hartry et al. | 84/413 |
| 4,714,002 | | 12/1987 | Cleland | 84/413 |
| 4,928,565 | | 5/1990 | Hsieh | 84/411 R |
| 5,031,499 | | 7/1991 | Wang et al. | 84/411 M |
| 5,447,087 | | 9/1995 | Hawes | 84/413 |
| 5,517,890 | * | 5/1996 | Cooperman | 84/411 R |
| 5,554,812 | | 9/1996 | Donohoe | 84/413 |
| 5,587,544 | * | 12/1996 | Fujii et al. | 84/411 R |

FOREIGN PATENT DOCUMENTS

| | | | |
|---|---|---|---|
| 95131 | | 1/1897 | (DE) . |
| 1218544 | * | 12/1959 | (FR) . |
| 8900237 | * | 9/1990 | (NL) . |

* cited by examiner

*Primary Examiner*—Shih-Yung Hsieh
(74) *Attorney, Agent, or Firm*—Bromberg & Sunstein LLP

(57) ABSTRACT

A percussion instrument, including a drum of any variety, having a tension member disposed between the drumhead and the end of the shell of the drum. The tension member maintains substantially constant radial tension on the skin in light of ambient conditions. The tension member may be a rigid member fixedly coupled to the end of the shell.

5 Claims, 1 Drawing Sheet

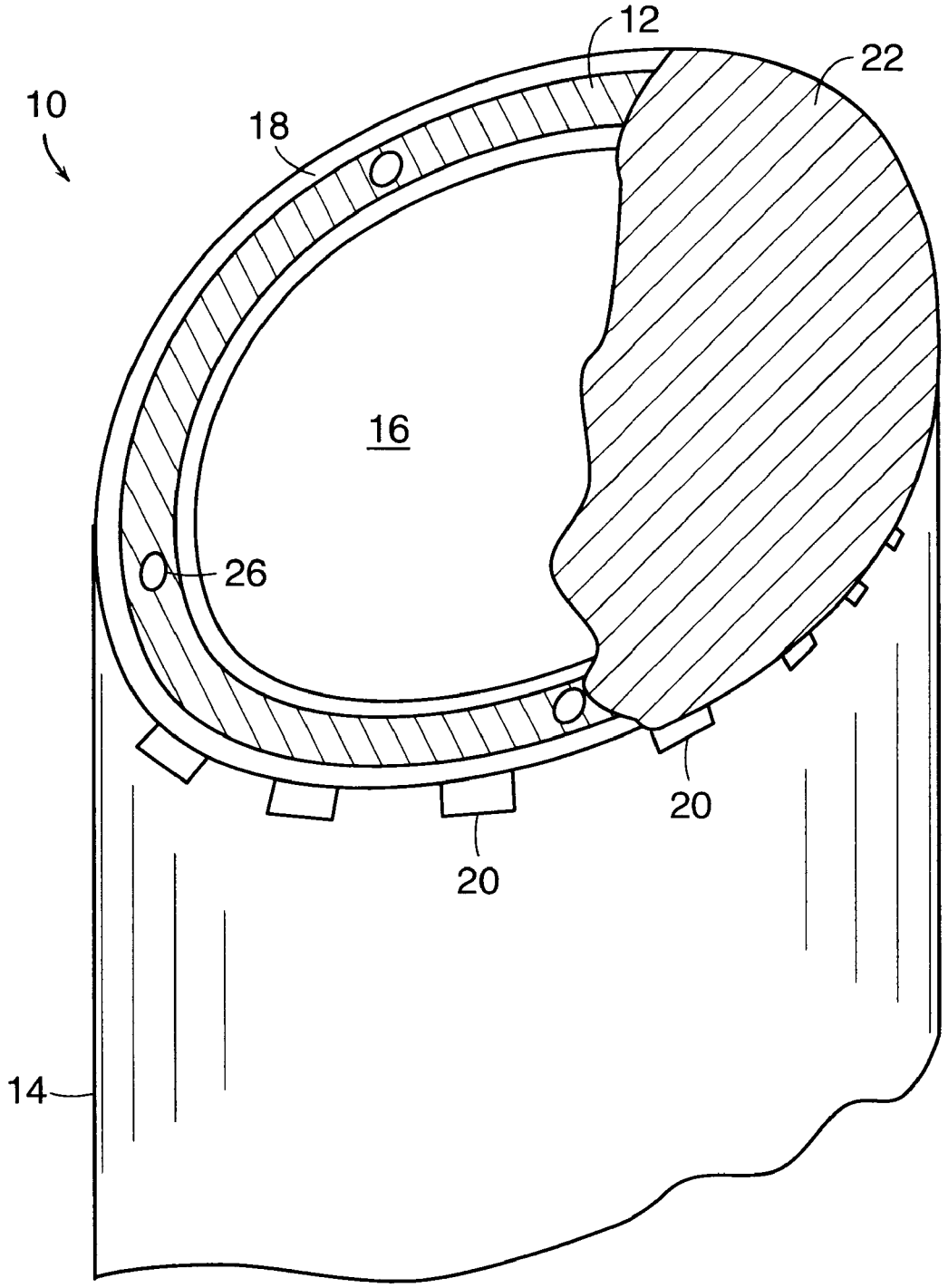
12
22
10
18
16
26
20
20
14

TENSION MEMBER FOR PERCUSSION INSTRUMENT

This application is a Continuation-in-Part of application Ser. No. 09/218,798 filed Dec. 21, 1998 which is incorporated herein by reference.

TECHNICAL FIELD

The present invention relates to a tension member for providing constant tension to the skin of a percussion musical instrument.

BACKGROUND OF THE INVENTION

A "drum," as used in this application and in any appended claims, refers to a percussion instrument that is sounded by striking or otherwise acoustically exciting a skin or membrane, sometimes referred to as a "drumhead" in this specification, stretched across an aperture formed by the shell of the instrument. Drums clearly antecede written human history. The tone produced by a drum is due to vibrations excited in the skin and varies as the material properties of the skin changes. These properties include the tension in the skin. The design of a drum may provide for modifying the tension in the skin of the drumhead. In particular, tension may be provided by tension members adjusted by means of adjustment screws, for example. Alternatively, the skin may be fixed to the frame. In either case, the tension in the skin of the drumhead may vary due to changes in ambient temperature or humidity differentially affecting the drumhead and the frame. In the case of drums with adjustable skin tensions, changes in tension due to variations in ambient conditions require readjustment of the tension.

SUMMARY OF THE INVENTION

In accordance with a preferred embodiment of the present invention, there is provided a percussion instrument. The percussion instrument, which may be a drum of any variety, has a shell formed of a first rigid material having an end of substantially annular cross-section. The drum has a drumhead stretched over an end of the shell which is fixedly attached to an exterior surface of the shell such that the tension in the drumhead cannot be adjusted manually, and a tension member, formed of a second rigid material, disposed between the skin and the end of the shell for maintaining a substantially constant radial tension in the drumhead. In accordance with an alternate embodiment of the invention, the tension member may be an annulus fixedly coupled to the end of the shell and the member may be plastic. The drumhead may be fixedly attached to the shell such that the tension in the drumhead cannot be adjusted manually.

In accordance with another aspect of the present invention, there is provided a method for compensating tension in a drumhead of a drum, the drum having a shell formed of a first rigid material, for variations in ambient conditions. The method has the steps of affixing a tension member formed of a second rigid material to an end of the shell of the drum, stretching the drumhead over the tension member, and fixedly attaching the drumhead to the exterior surface of the shell such that the tension in the drumhead cannot be manually adjusted.

BRIEF DESCRIPTION OF THE DRAWINGS

The invention will be more readily understood by reference to the following description, taken with the accompanying drawing, in which:

FIG. 1 is a perspective view of a drum, in which the drumhead surface is cutaway in part, showing the underlying tension member coupled to the shell of the drum, in accordance with a preferred embodiment of the present invention.

DETAILED DESCRIPTION OF SPECIFIC EMBODIMENTS

In accordance with preferred embodiments of the present invention, a drum, designated generally by numeral 10 is provided wherein a substantially constant tension is maintained on a drumhead 22 (shown as cutaway in part) by means of a tension member 12. Shell 14 of drum 10 forms a hollow drum body in which air is resonantly excited by vibrations of the drumhead. Drumhead 22, of natural or synthetic material, is typically stretched across an aperture 16 in shell 14.

The perimeter of aperture 16 may change with expansion of shell 14 due to variations in ambient temperature or humidity. To the extent to which frame variations with temperature or humidity are not entirely homologous with drumhead variations, the tension on the drumhead will not remain constant, and the sound of the drum will vary with ambient conditions. This effect is due, in particular, to the drum frame being composed of a different material from that of the drumhead.

In order to maintain a substantially constant tension on the drumhead, tension member 12 is fastened to shell 14, such as by screws 26 in accordance with preferred embodiments of the invention, between end 18 of shell 14 and the drumhead 22. By virtue of the choice of material and dimension, tension member 12 reduces differential expansion of the frame with respect to the drumhead, thereby maintaining a substantially constant tension on the head. All drums wherein a tension member 12 is disposed between end 18 of shell 14 and the drumhead for providing substantially constant tension on the drumhead are within the scope of the present invention. Shell 14 may typically be wood, metal, or either a natural or synthetic material, whereas the drumhead is typically a different material.

The tension member 12, which is preferably plastic but may be low expansion metal or other rigid material, is used for maintaining a substantially constant tension in the drumhead. Tension member 12 is attached in a fixed manner to end 18 of shell 14 by screws 26, staples, or pins, or any known bonding methods. Tension member 12 has a radial width on the order of the width of the annular end 18 of the shell, typically about 1 cm, and a thickness typically 2–4 mm. For the preferred embodiment, substantially constant drumhead tension is maintained over the typical ambient conditions of an environment conducive to musical performance. The drumhead skin may be attached to shell 14 in a stretched condition by means of fasteners 20. Under particular circumstances, a tensioning mechanism may also be employed.

The described embodiments of the invention are intended to be merely exemplary and numerous variations and modifications will be apparent to those skilled in the art. All such variations are intended to be within the scope of the present invention as defined in the appended claims.

We claim:

1. A percussion instrument comprising:

a. a shell formed of a first rigid material having an end of substantially annular cross-section;

b. a drumhead stretched over an end of the shell and fixedly attached to an exterior surface of the shell such that the tension in the drumhead cannot be adjusted manually; and c. a tension member of a second rigid material disposed between the drumhead and the end of the shell for maintaining substantially constant radial tension on the drumhead.

2. A percussion instrument according to claim 1, wherein the tension member is a rigid member fixedly coupled to the end of the shell.

3. A percussion instrument according to claim 2, wherein the tension member is plastic.

4. A percussion instrument according to claim 1, wherein the tension member is an annulus.

5. A method for compensating tension in a drumhead of a drum, the drum having a shell formed of a first rigid material, for variations in ambient conditions, the method comprising:

a. affixing a tension member formed of a second rigid material to an end of the shell; and b. stretching the drumhead over the tension member; and c. fixedly attaching the drumhead to the exterior surface of the shell such that the tension in the drumhead cannot be manually adjusted.

* * * * *